United States Patent [19]

Hammer et al.

[11] 4,149,328

[45] Apr. 17, 1979

[54] STEAM IRON

[75] Inventors: Urs Hammer, Oberbuchsiten; Ernst Gisiger, Niederbuchsiten, both of Switzerland

[73] Assignee: Jura Elektroapparate-Fabriken L. Henzirohs A.G., Canton of Soleure, Switzerland

[21] Appl. No.: 814,469

[22] Filed: Jul. 11, 1977

[30] Foreign Application Priority Data

Jul. 21, 1976 [CH] Switzerland ..... 9326/76

[51] Int. Cl.[2] ..... D06F 75/06

[52] U.S. Cl. ..... 38/77.83

[58] Field of Search ..... 38/77.5, 77.6, 77.7, 38/77.8, 77.81, 77.82, 77.83

[56] References Cited

U.S. PATENT DOCUMENTS

| | | | |
|---|---|---|---|
| 186,741 | 1/1877 | Maas et al. | 38/77.5 |
| 2,483,579 | 10/1949 | Green | 38/77.83 |
| 2,782,537 | 2/1957 | Vera-Mege | 38/77.83 |
| 2,861,363 | 11/1958 | Finlayson | 38/77.83 |
| 3,038,269 | 6/1962 | Knapp | 38/77.5 |
| 3,292,283 | 12/1966 | Hahner | 38/77.5 |
| 3,823,498 | 7/1974 | Davidson et al. | 38/77.83 |

*Primary Examiner*—Patrick D. Lawson

*Attorney, Agent, or Firm*—Zarley, McKee, Thomte, Voorhees & Sease

[57] ABSTRACT

A steam iron having a spout in the form of a spray nozzle projecting into a steam chamber for causing uniform puffs of steam to be ejected from a number of outlets in the sole plate of the iron whenever desired during ironing. The spout is fed by a pump disposed in a water reservoir. The spray-nozzle design of the spout also prevents excessive localized cooling in the steam chamber.

2 Claims, 1 Drawing Figure

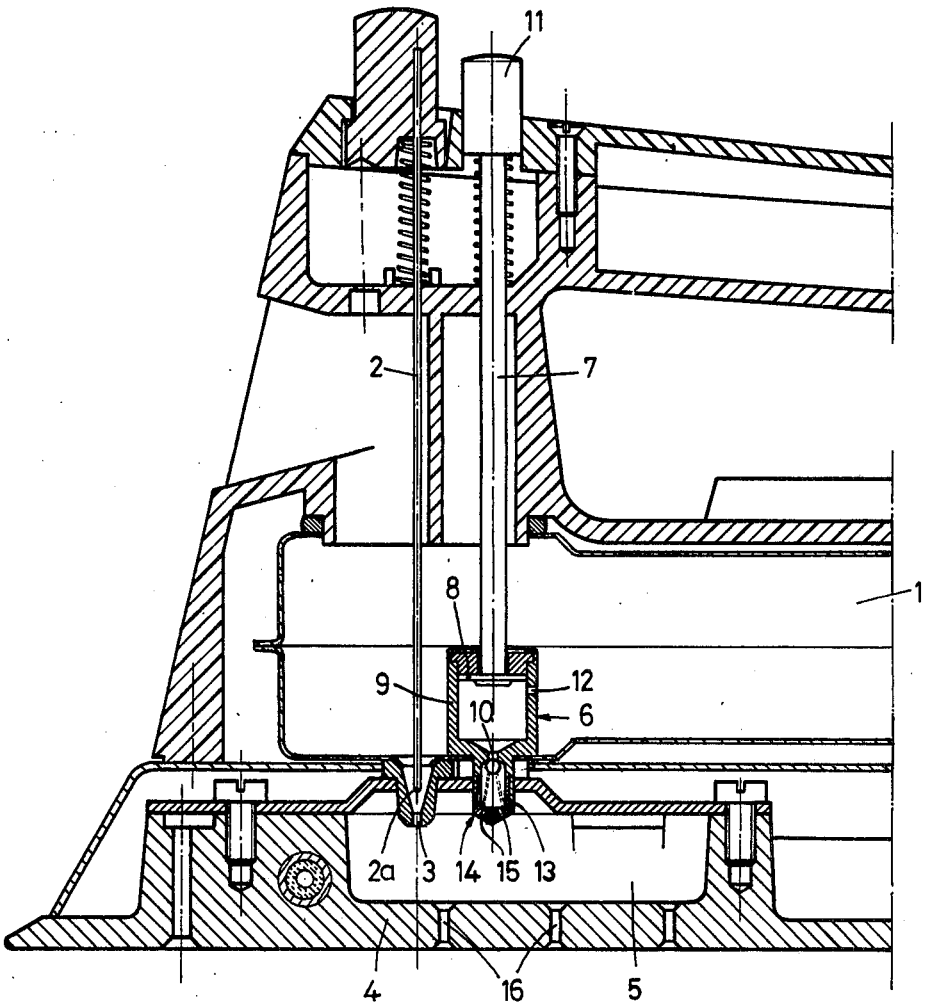
11
2
7
1
8
9
12
10
6
2a
3
14
15
13
4
16
5

STEAM IRON

This invention relates to steam irons of the type having a water reservoir, a port forming a passage between the water reservoir and a steam chamber, a movable needle for closing and opening the port, and a pump disposed in the water reservoir for temporarily introducing additional water into the steam chamber through a spout projecting into the steam chamber.

Steam irons of this type are already known. They include means for causing puffs of steam to be ejected from the iron by briefly introducing additional water into the steam chamber, drop by drop, by means of a pump. One disadvantage of this arrangement is that the dripping water tends to produce, over a very small area but to a relatively high degree, a cooling-off of the bottom of the steam chamber. Moreover, the additional steam is produced only at a certain point, so that it is not ejected with equal force through all of the outlets in the sole plate of the iron.

It is an object of this invention to provide an improved steam iron in which these drawbacks are eliminated, i.e., an iron in which intense, localized cooling is avoided and an additional puff of steam is produced that is uniformly effective at all of the steam outlets.

To this end, in the steam iron according to the present invention, the improvement comprises a spout taking the form of a spray nozzle.

A preferred embodiment of the invention will now be described in detail with reference to the accompanying drawing, the sole FIGURE of which is a section through the front part of a steam iron according to the invention.

The steam iron illustrated in the drawing comprises a water reservoir 1 which can communicate with a steam chamber 5, sunk in a sole plate 4, by means of a port 3 which can be closed by a valve stem 2, the lower end of valve stem 2 taking the form of a needle 2*a*. The iron further comprises a pump 6 disposed in reservoir 1 and made up of a piston rod 7, a piston 8, a cylinder 9, and a check valve 10. By means of an operating button 11, piston rod 7 can be caused to move upwards together with piston 8, thus drawing in through a cylinder opening 12 a limited amount of water corresponding to the volume of cylinder 9, whereupon depression of button 11 causes this amount of water to be supplied through check valve 10 and a delivery spout 13 to steam chamber 5. Spout 13 projects into steam chamber 5 and takes the form of a spray nozzle in that is comprises a cap 14 perforated by a number of spray ducts 15.

Port 3 represents the normal means of communication between reservoir 1 and steam chamber 5. The position shown in the drawing, in which valve stem 2 is withdrawn from port 3, is the normal operating position. Piston 8, together with cylinder 9, is used for supplying the additional water, which reaches steam chamber 5 through check valve 10 and spray ducts 15.

As a result of this design of delivery spout 13, the water entering steam chamber 5 owing to depression of operating button 11 is sprayed out and hence distributed over the whole bottom of steam chamber 5. Therefore, the additional water is not supplied drop by drop at a certain point but uniformly over the entire bottom surface of steam chamber 5, thus avoiding intensive, localized cooling-off and ensuring that the steam produced can be uniformly ejected through all steam outlets 16.

What is claimed is:

1. In a steam iron having a water reservoir, a steam chamber having a bottom surface, a spout projecting into said steam chamber, a port forming a passage between said water reservoir and said steam chamber, a movable needle for closing and opening said port, and a pump disposed in said water reservoir for temporarily introducing additional water into said steam chamber through said spout, the improvement comprising said spout taking the form of a spray nozzle having a cap perforated by a plurality of spray ducts, said ducts being inclined laterally outwardly at an angle to the longitudinal axis of said spout and spaced apart whereby water pumped from said reservoir and sprayed through said ducts is distributed over substantially the entire bottom surface.

2. The device of claim 1 wherein said steam chamber includes a plurality of steam outlets through said bottom surface.

* * * * *